US006541725B2

(12) United States Patent
Pearson

(10) Patent No.: US 6,541,725 B2
(45) Date of Patent: Apr. 1, 2003

(54) ACOUSTICAL APPARATUS AND METHOD FOR SORTING OBJECTS

(75) Inventor: Thomas C. Pearson, Berkeley, CA (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 09/826,518

(22) Filed: Apr. 3, 2001

(65) Prior Publication Data

US 2002/0139729 A1 Oct. 3, 2002

(51) Int. Cl.[7] ..... B07C 5/00

(52) U.S. Cl. ..... 209/590; 209/599; 209/639; 209/932

(58) Field of Search ..... 209/552, 576, 209/590, 599, 639, 644, 932, 638

(56) References Cited

U.S. PATENT DOCUMENTS

| | | | | |
|---|---|---|---|---|
| 4,147,620 A | * | 4/1979 | Artiano et al. | 209/590 |
| 4,212,398 A | * | 7/1980 | Parker et al. | 209/639 X |
| 4,602,716 A | * | 7/1986 | Barla-Szabo et al. | 209/599 |
| 4,625,872 A | | 12/1986 | DeLacy et al. | |
| 5,703,784 A | | 12/1997 | Pearson | |

FOREIGN PATENT DOCUMENTS

| | | | | |
|---|---|---|---|---|
| EP | 212516 | * | 3/1987 | 209/590 |
| FR | 2635993 | * | 3/1990 | 209/590 |

OTHER PUBLICATIONS

Younce, F.L., and Davis, D.C., "A Dynamic Sensor for Cherry Firmness," *Transactions of the ASAE* (1995) 38(5):1467–1476.

Pearson, T., and Toyofuku, N., "Automated Sorting of Pistachio Nuts with Closed Shells," *Applied Engineering in Agriculture* (Jan. 2000) 16(1):91–94.

De Ketelaere, B., Coucke, P., and De Baerdemaeker, J., "Eggshell Crack Detection based on Acoustical Resonance Frequency Analysis," *J. agric. Engng Res.* (Mar. 2000) 76:157–163.

* cited by examiner

*Primary Examiner*—Tuan N. Nguyen
(74) *Attorney, Agent, or Firm*—Margaret A. Connor; John D. Fado

(57) ABSTRACT

An object, such as a pistachio nut, is sorted based on a given trait. The sorting process commences by bouncing the object off a body so that the object emits a sound. The sound emitted by the object is converted to an electrical signal which is analyzed to determine electrical characteristics that indicate the trait of the object. For example, the electrical signal can be integrated and a signal gradient produced to discriminate among signals from different classes of objects.

8 Claims, 4 Drawing Sheets

OPEN SHELL
CLOSED SHELL
46
44
1.0
0.5
0.0
-0.5
-1.0
MICROPHONE OUTPUT VOLTAGE
0
200
400
600
800
1000
1200
1400
TIME AFTER IMPACT (MICRO-SECONDS)

ACOUSTICAL APPARATUS AND METHOD FOR SORTING OBJECTS

BACKGROUND OF THE INVENTION

The present invention relates to equipment for automatically sorting objects, such as pistachio nuts; and more particularly to such equipment which sorts the objects based on sound.

Pistachio nuts are graded and sorted based on whether or not the shell has split open. A typical harvest of pistachio nuts comprises 17% with a closed shell, 5% with a thinly split shell, and 78% with a fully open shell. Nuts with closed shells have low consumer acceptance because they are difficult to open and may contain immature kernels. Thus closed shell pistachio nuts are less valuable than those with open shells.

The pistachio industry currently utilizes a variety of methods and equipment to sort lesser quality nuts from the high grade product. A common mechanical device has a rotating drum with pins projecting inward from the interior surface. As the pistachio nuts tumble in the drum, those with open shells become lodged on the pins and carried upward. At the top of the drum a brush removes the open nuts from the pins and those nuts fall onto a collector. The pins can not impale the pistachio nuts with closed shells and these nuts pass through the drum into another collector.

Furthermore, approximately five to ten percent of open shell pistachio nuts are incorrectly classified by the mechanical sorters as having a closed shell. Such incorrect classification costs the U.S. pistachio industry several millions of dollars a year.

Machine vision systems also have been proposed for sorting pistachio nuts. However, these systems are relatively expensive and have a classification accuracy similar to that of mechanical sorting machines. Thus vision systems may not be economically justified.

Therefore, there remains a need to increase the accuracy of the sorting process for closed shell pistachio nuts.

SUMMARY OF THE INVENTION

The present novel object sorting method commences by creating an impact between the object and a body, such as by bouncing the object off the body. Preferably the body has a sufficiently large mass that it does not emit sound due to the impact. However, the object does emit a sound upon impact and a transducer produces an electrical signal representing that sound.

The electrical signal is analyzed to determine a characteristic of the electrical signal which indicates a trait of the object on which sorting is to be based. For example, this method has application in sorting pistachio nuts based on whether their shells are open or closed. In response to the results of the analysis the object is directed along a selected a path.

Analysis of the electrical signal preferably involves integrating a magnitude of the electrical signal, deriving a gradient for a portion of the electrical signal, or both of those arithmetic operations. In the preferred processing technique, the electrical signal is digitized into a plurality of signal samples. Then the absolute value of selected signal samples, acquired during a predefined interval after the impact, are integrated to produce an integration value. In addition, that signal samples which have a magnitude in a first predetermined range of values and a gradient in a second predetermined range of values are counted to produce a first count value. A second count value may be produced by counting the signal samples which have a magnitude in a third predetermined range of values and a gradient in a fourth predetermined range of values. The integration value and the first and second count values then are utilized to classify the object and the classification determines along which path to direct the object.

DETAILED DESCRIPTION OF THE INVENTION

Although the present invention will be described in terms of apparatus for sorting pistachio nuts, the inventive concept can be applied to sorting other types of agricultural products.

Figure 1:
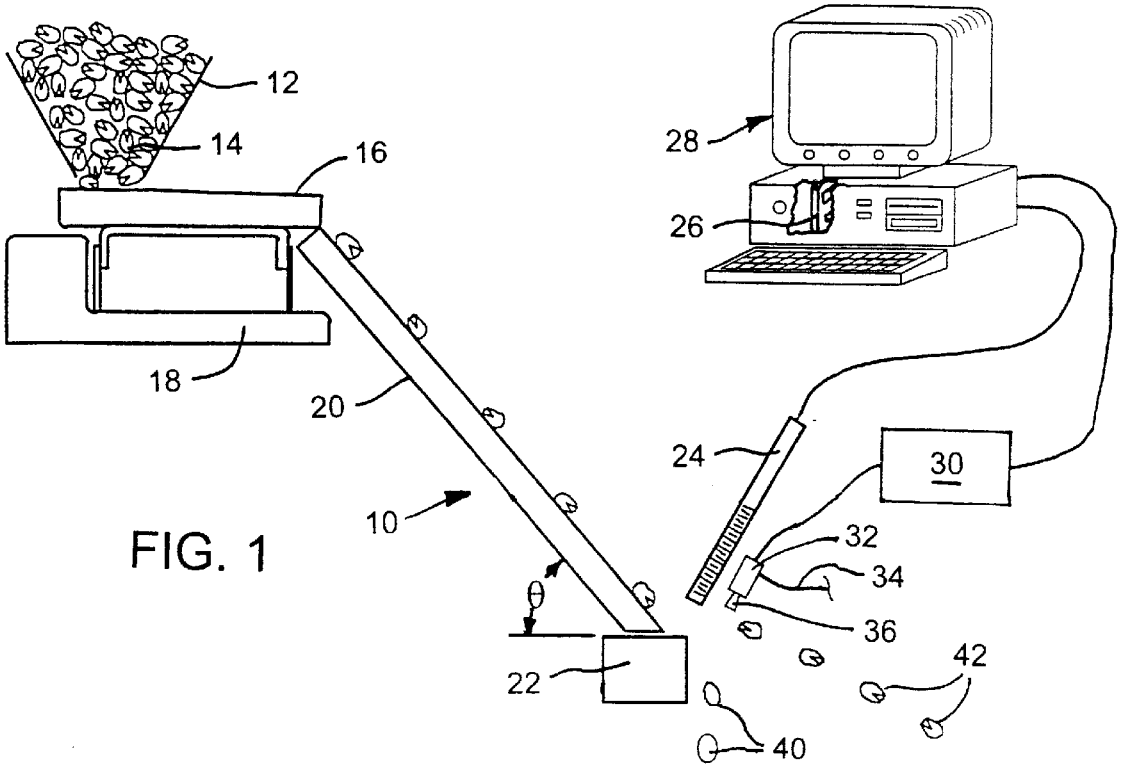
FIG. 1 is a diagram of an apparatus for sorting pistachio nuts.

With initial reference to FIG. 1, the sorting apparatus 10 has hopper 12 into which the pistachio nuts 14 are received for processing. The nuts drop through the hopper 12 onto a tray 16 of a vibrating feeder 18. As the tray 16 vibrates, the nuts pass through an outlet in the tray and fall one at a time onto a chute 20, thus creating a linear stream of nuts.

The chute 20 is a "V" trough of polished stainless steel that angles downward toward an impact plate 22 of polished stainless steel. For example, the chute is one meter long and is inclined at an angle θ of sixty degrees with respect to horizontal. As each nut 14 slides down the chute 20, its longitudinal axis is oriented parallel to the direction of the travel. In the preferred embodiment of the sorting apparatus 10, the impact plate 22 is 50.8 mm wide by 50.8 mm thick. The relatively large thickness of the impact plate 22 minimizes vibration of the block upon being impacted by the stream of pistachio nuts. As a consequence, the sound generated by the impact originates primarily from the nut.

A highly directional "shotgun" microphone 24 is aimed at the location on the impact plate 22 which will be struck by the falling pistachio nuts. For example, the microphone 24 is a model ME67 with a K6 powering module sold by Sennheiser Electronics Corporation of Old Lyme, Conn. 06371 U.S.A. The highly directional nature of this microphone and careful aiming minimizes mixing ambient noise with the sound from the bouncing nuts.

The electrical signal produced by the microphone 24 is applied to an analog input of a digital signal processor (DSP) 26 contained on a card inserted in a personal computer 28. For example, the digital signal processor 26 is a model 310 manufactured by Dalanco Spry of Rochester, N.Y. 14620, U.S.A. An analog-to-digital converter in the digital signal processor 26 converts the microphone signal to digital samples with 14 bit resolution at a rate of 250 KHz. thereby acquiring a data sample of the microphone signal once every four microseconds. As will be described, the digital signal processor analyzes the audio signal emitted by each bouncing nut to determined whether its shell is open or closed.

The digital signal processor 26 has an analog output that is connected to a driver circuit 30 for an electrically operated solenoid valve 32. The solenoid valve 32 is connected to a supply line 34 from a source of compressed air (not shown).

When the valve 32 is opened, in response to the output signal from the digital signal processor 26, compressed air is expelled through a nozzle 36 across the path of the pistachio nuts that have bounced off the impact plate 22. The stream of compressed air from the nozzle 36 blows selected pistachio nuts 40 in a different direction from the normally bouncing nuts 42.

Figure 2:
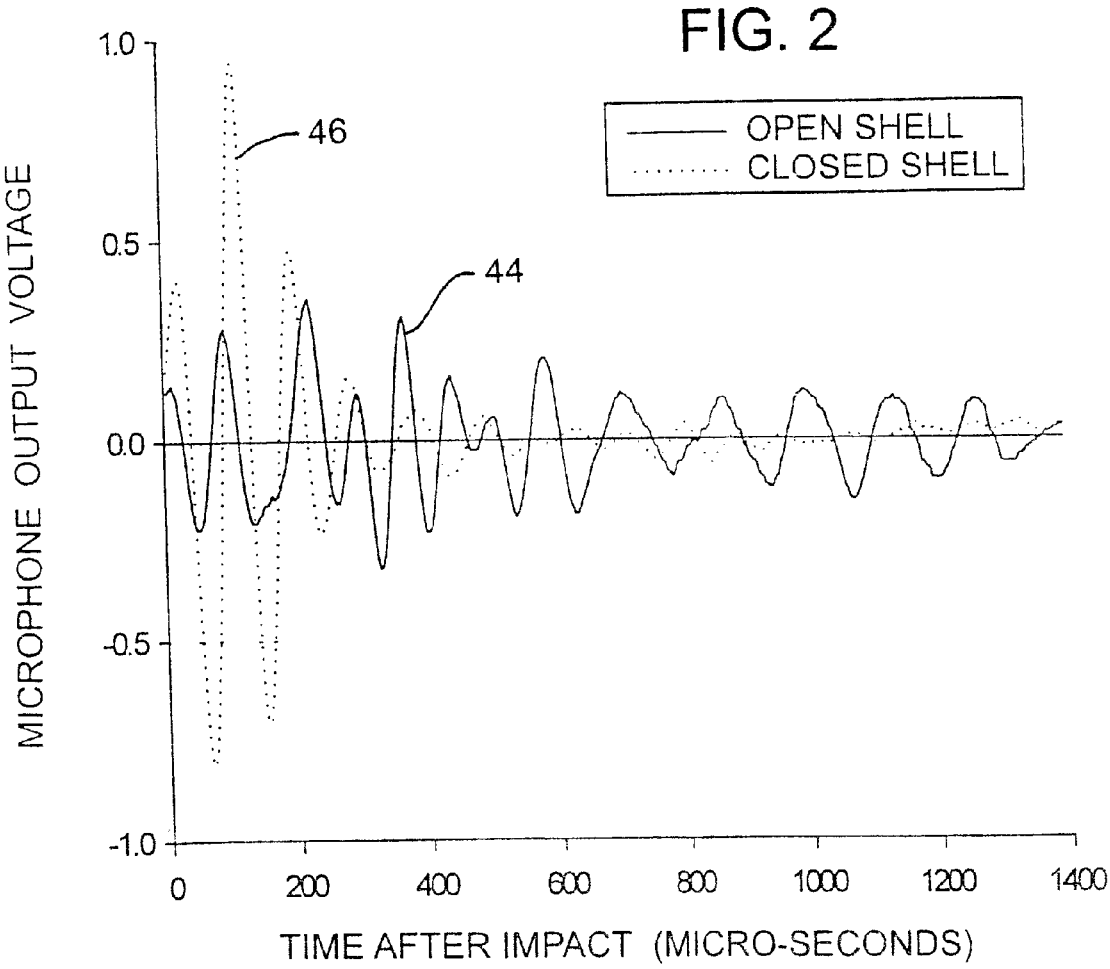
FIG. 2 graphically illustrates waveforms of the sound emitted from pistachio nuts with open and closed shells bouncing off an impact plate of the apparatus.

FIG. 2 depicts electrical signals from the microphone 24. The solid waveform 44 represents the sound emitted from a nut with an open shell, while the dotted waveform 46 corresponds to the sound from a nut with a closed shell. The waveform 44 for an open shell nut begins oscillating with a relatively moderate amplitude and keeps this moderate amplitude for most of the 1400 microsecond interval during which 350 data samples are acquired by the digital signal processor 26. In contrast, the signal waveform 46 for the closed shell nut begins with oscillations of a relatively high amplitude during the first 300 microseconds after impact and diminishes significantly thereafter. These diverse audio signals enable the present sorting system to differentiate between pistachio nuts with closed and open shells.

The signal features used for classification are extracted concurrently with the data acquisition. These features can be extracted from either the absolute value of the signal level (signal magnitude), the absolute value of the signal gradient, or both. The signal gradient is computed from:

$$G_X=|I_{(X-GAP)}-I_{(X+GAP)}|$$

where $G_X$ is the signal gradient value at data sample X; $I_X$ is the signal level for data sample X; and GAP is the interval between data samples. Signal gradients are computed using GAPs of two, three, and four data samples.

For separating closed-shell from open-shell pistachio nuts, a three-variable linear discriminate function was found to provide the lowest validation set classification error rate in real-time. The function used the following feature parameters:

1. Integration of the absolute value of signal magnitude for 0.11 milliseconds (ms) after impact.
2. The number of data samples taken between 0.6 and 1.4 milliseconds after impact which have a magnitude below 45.8 millivolts (mv) and a gradient (2-point GAP) below 45.8 millivolts.
3. The number of data sample taken between 0.6 and 1.4 milliseconds after impact which have a magnitude below 57.2 millivolts and a gradient (3-point GAP) below 30.5 millivolts.

Although the use of all three parameters is preferred to fully classify nuts as closed or open, it should be understood that an alternative sorting apparatus could utilize only one of these parameters or any two of them. Furthermore, the signal levels used may vary depending upon the object being sorted and the configuration of the system hardware, such as the chute 20, impact plate 22 or the microphone 24. For example, changing the length and angle of the chute can affect the intensity of the sound emitted by the pistachio nut upon impact. The specific signal intensities specified in these feature parameters were selected to distinguish between the two waveforms shown in FIG. 2 and those signal intensity values will change when other objects being sorted produce different waveforms.

Figure 3A:
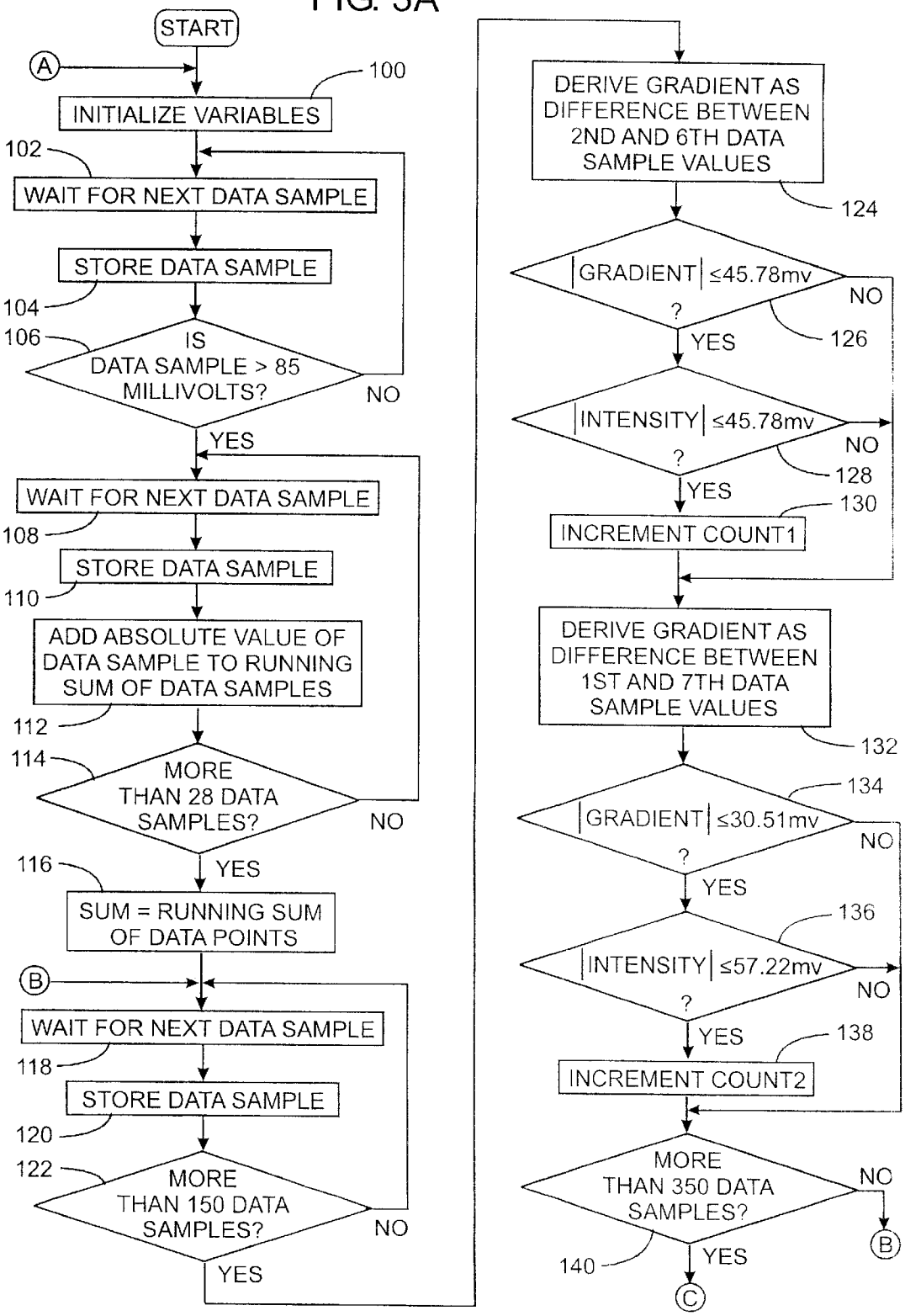
FIGS. 3A and 3B are a flowchart depicting operation of the present sorting apparatus.

The classification function is implemented by programming the digital signal processor 26 to evaluate the microphone signal for 1.4 milliseconds which is the time required to obtain 350 digital data samples for each nut. The evaluation program is depicted by the flowchart which begins on FIG. 3A. At the commencement of data acquisition for a new nut the variables are initialized at step 100 after which the digital signal processor waits at step 102 for another data sample to be acquired. Each data sample is stored in the digital signal processor 26 at step 104.

At step 106 a determination is made whether the magnitude of the new data sample exceeds 85.0 millivolts which indicates that a nut has bounced off the impact plate 22 in FIG. 1. This signal threshold prevents ambient background noise from triggering the signal processing. This and other signal magnitudes specified herein may vary depending upon the particular environment and components of a particular sorting apparatus. Once a data sample produced by a nut bounce has been found, the program execution advances to step 108 where the processor waits for another data sample. That sample is stored into a pipeline memory within the digital signal processor 26 at step 110.

The signal gradient and intensity of each data sample of the microphone signal are utilized to derive the three feature parameters that quantify the signal characteristics of the impacting pistachio nut.

The first parameter of the microphone signal quantifies the overall signal amplitude during the initial 0.08 milliseconds after impact, which corresponds to 28 data samples acquired after the microphone signal exceeded 85 millivolts. Specifically at step 112, the absolute value of each data sample is computed and added to a running sum of all previous data samples for this particular nut. Next at step 114, a determination is made whether 28 data samples have been summed which is achieved by a count of the total number of data samples acquired since initialization. The program keeps looping through steps 108–114 until 28 data sample have been acquired. Thereafter, the program execution advances to step 116 where the running sum computed in step 112 is stored in memory as a variable denoted SUM.

Next, the process enters a loop which acquires data for another 0.488 milliseconds, or until a total of 150 data samples have been acquired. Specifically at step 118, the program waits for the next data sample from the analog-to-digital converter in the digital signal processor 26 and stores the new sample in the pipeline memory at step 120. A determination is made at step 122 when a total of 150 samples have been acquired, at which time the program advances to step 124.

At this juncture, the two additional parameters (COUNT1 and COUNT2) related to signal amplitude are derived by counting the number of data samples that have both an intensity and a gradient within specified value ranges. The parameter COUNT1 tabulates data samples with an absolute signal gradient value less than or equal to 45.78 millivolts and an absolute signal intensity less than or equal to 45.78 millivolts. This characterizes a relatively small signal amplitude in this region of the signal, which is characteristic of closed shell pistachio nuts. This parameter calculation commences at step 124 by computing the signal gradient value which is the difference between the values of the second and sixth most recently acquired data samples in the memory pipeline. Then at step 126, this signal gradient value is tested to see if it falls within the specified range, i.e. is less than or equal to 45.78 millivolts. If that is not the case, the most recent data sample does not satisfy the criteria for the COUNT1 parameter and the program jumps to step 132 without incrementing that parameter count. Otherwise the program execution advances to step 128 where the absolute signal intensity value for the most recent data sample is tested to see if it falls within the specified range, i.e. is less than 45.78 millivolts. If that is true, the variable for parameter COUNT1 is incremented at step 130.

Similarly, the value of parameter COUNT2 is computed by counting data samples with an absolute signal gradient value less than or equal to 30.51 millivolts and an absolute signal intensity less than or equal to 57.22 millivolts. This characterizes a small signal amplitude in this region of the signal, which is characteristic of closed shell pistachio nuts. A signal gradient value is computed at step 132 as the difference between the values of the first and seventh most recently acquired data samples in the memory pipeline. Next, at step 134 a determination is made whether the new signal gradient value is less than or equal to 30.51 millivolts. If so, a determination is made whether the signal intensity value for the present data sample is less than or equal to 57.22 millivolts. If that is the case, the parameter COUNT2 is incremented at step 138. The parameter COUNT2 is not incremented when either condition specified at steps 134 and 136 is not satisfied.

Figure 3B:
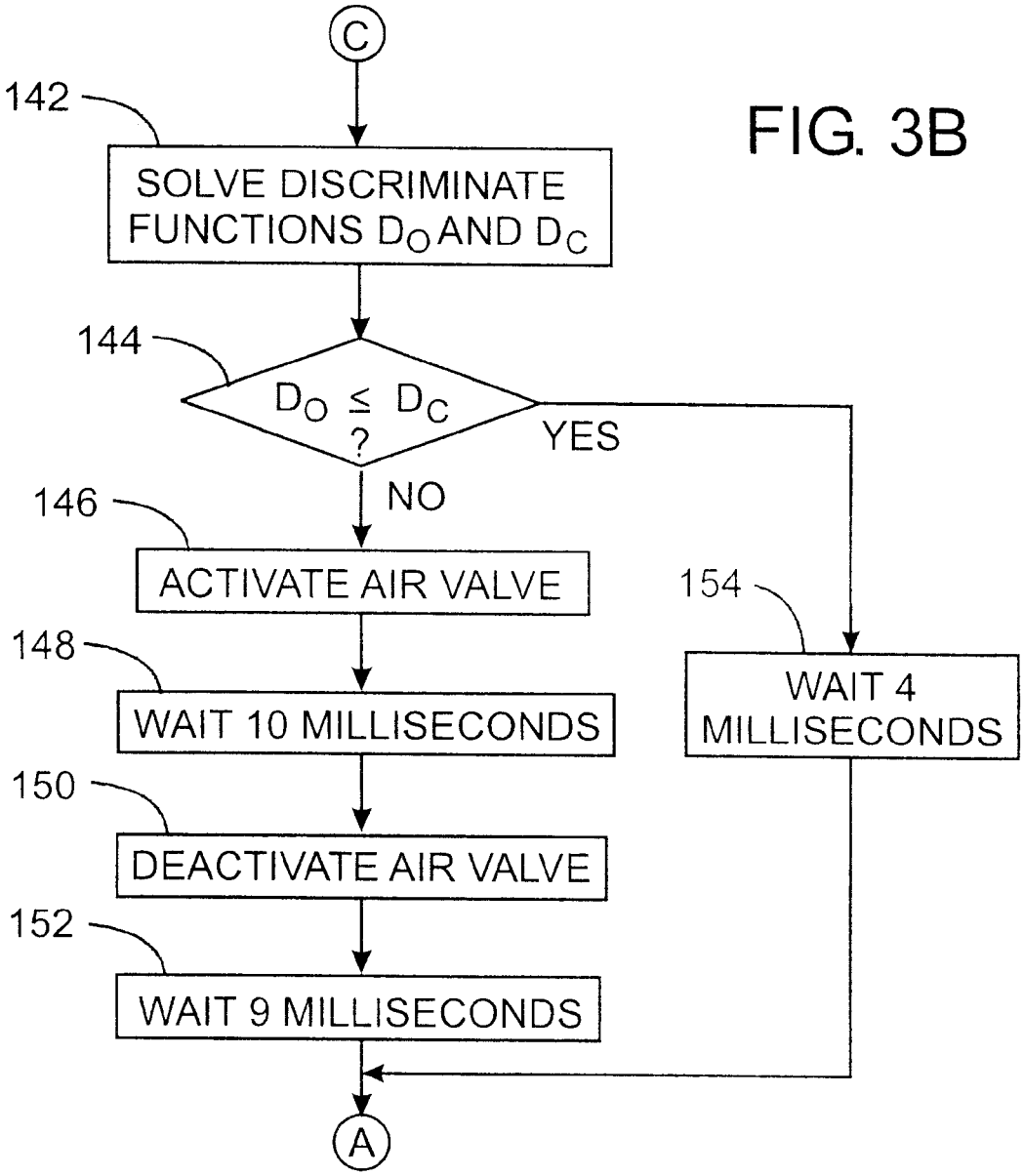

The evaluation of the microphone signal by the digital signal processor 26 loops through steps 118–138, continuing to compute the two parameters COUNT1 and COUNT2, for 1.4 milliseconds during which interval 350 total data samples have been acquired for the current nut. When this occurs as determined at step 140, the program advances to step 142 on FIG. 3B.

At this point discriminate functions are solved to determine whether the present nut is open or closed. The discriminate functions $D_O$ for open shell nuts and $D_C$ for closed shell nuts are:

$$D_O=C_{O1}-C_{O2}(\text{SUM})-C_{O3}(\text{COUNT1})+C_{O4}(\text{COUNT2})$$

$$D_C=C_{C1}-C_{C2}(\text{SUM})-C_{C3}(\text{COUNT1})-C_{C4}(\text{COUNT2})$$

where $C_{XX}$ are constants having the following values: $C_{O1}$=44939, $C_{O2}$=430, $C_{O3}$=751, $C_{O4}$=211, $C_{C1}$=268020, $C_{C2}$=1152, $C_{C3}$=205, and $C_{C4}$=1419. The precise discriminate functions and constants employed will vary depending upon the specific type of object being sorted and configuration of the sorting system.

Then the program execution advances to step 144 where the values of the discriminate functions $D_O$ and $D_C$ are compared. The value of the open shell discriminate function $D_O$ being less than the value of closed shell discriminate function $D_C$ indicates a likelihood that the present nut belongs to the open shell class, in which event the program execution jumps to step 150.

When the closed shell discriminate function $D_C$ has a lesser value than the open shell discriminate function $D_O$, there is greater likelihood that this nut belongs to the closed shell class. In this event, the program proceeds to step 146 where the digital signal processor 26 produces an analog output signal that activates the solenoid valve 32. Then at step 148, a delay occurs to provide a ten millisecond blast of compressed air to blow the present nut along the path of nuts 40. In the absence of a compressed air blast the nuts 42 that are open bounce along a different path. After that delay the analog output signal from the digital signal processor 26 terminates at step 150 and the solenoid valve 32 closes.

When the solenoid valve 32 is open, the microphone signal rises to high levels due to the air blast and exceeds the signal levels expected from a nut. Therefore, the signal processing delays at step 152 for nine milliseconds to allow the microphone 24 settle down so that its output signal will not cause another execution cycle of the program. A four millisecond delay also occurs at step 154 when the solenoid valve 32 is not activated to ensure that an open nut 42 travels far enough away from the microphone 24 so that any sound continuing to be emitted also does not reactive program execution. After that delay, the program returns to step 100 to await another nut bouncing off the impact plate 22.

The foregoing description is directed to the preferred embodiment of the invention. Although some attention was given to various alternatives within the scope of the invention, skilled artisans will likely realize additional alternatives that are now apparent from the disclosure of those embodiments. Accordingly, the scope of the invention should be determined from the following claims and not limited by the above disclosure.

I claim:

1. A method for sorting an object comprising:

creating an impact between the object and a body;

producing an electrical signal representing sound emitted by the object after impact;

digitizing the electrical signal into a plurality of data samples;

processing the plurality of data samples to determine a characteristic of the electrical signal which indicates a trait of the object;

selecting a path along which to direct the object in response to the parameter of the electrical signal; and directing the object along the selected path;

wherein the processing comprises:

integrating of an absolute value of the plurality of data samples that represent the electrical signal during a predefined interval after the impact; and counting those of the plurality of data samples which have a magnitude in a first predetermined range of values and a gradient in a second predetermined range of values.

2. The method as recited in claim 1 wherein creating an impact comprises bouncing the object off the body.

3. A method for sorting an object comprising:

creating an impact between the object and a body;

producing an electrical signal representing sound emitted by the object after impact;

digitizing the electrical signal into a plurality of data samples;

processing the plurality of data samples to determine a characteristic of the electrical signal which indicates a trait of the object, wherein the processing comprises:

integrating of an absolute value of those of the plurality of data samples that represent the electrical signal during a predefined interval after the impact thereby producing an integration value;

counting those of the plurality of data samples which have a magnitude in a first predetermined range of values and a gradient in a second predetermined range of values thereby producing a first count; and counting those of the plurality of data samples which have a magnitude in a third predetermined range of values and a gradient in a fourth predetermined range of values thereby producing a second count;

selecting a path along which to direct the object in response to the parameter of the electrical signal; and directing the object along the selected path.

4. The method as recited in claim 3 wherein both of the counting steps occur for a predefined time interval which commences a given amount of time after the impact.

5. The method as recited in claim 3 wherein the processing further comprises utilizing the integration value, the first count, and the second count to solve a first discriminate function for a first class of objects thereby producing a first discriminate value;

utilizing the integration value, the first count, and the second count to solve a second discriminate function for the second class of objects thereby producing a second discriminate value; and wherein selecting a path is in response to the first discriminate value and the second discriminate value.

6. The method as recited in claim 5 wherein the first discriminate function $D_O$ is given by:

$$D_O = C_{O1} - C_{O2}(\text{SUM}) - C_{O3}(\text{COUNT1}) + C_{O4}(\text{COUNT2})$$

and the second discriminate function $D_C$ is given by:

$$D_C = C_{C1} - C_{C2}(\text{SUM}) - C_{C3}(\text{COUNT1}) - C_{C4}(\text{COUNT2})$$

where $C_{O1}$, $C_{O2}$, $C_{O3}$, $C_{O4}$, $C_{C1}$, $C_{C2}$, $C_{C3}$, and $C_{C4}$ are constants, SUM is the integration value, COUNT1 is the first count, and COUNT2 is the second count.

7. An apparatus for sorting an object, which apparatus comprises:

a mechanism which produces an impact between the object and a body;

a transducer which converts sound emitted by the object after impact into an electrical signal;

a processor connected to the transducer, the processor digitizing the electrical signal into a plurality of data samples and processing the plurality of data samples to determine a characteristic of the electrical signal which indicates a trait of the object, the processor responding to the characteristic by selectively producing an output signal; and a sorting device responsive to the output signal by directing the object along one of a plurality of paths;

wherein the processor:

integrates an absolute value of those of the plurality of data samples representing the electrical signal for a predefined interval after the impact to produce an integration value;

counts those of the plurality of data samples which have a magnitude in a first predetermined range of values and a gradient in a second predetermined range of values to produce a first count; and counts those of the plurality of data samples which have a magnitude in a third predetermined range of values and a gradient in a fourth predetermined range of values to produce a second count.

8. The apparatus as recited in claim 7 wherein the processor:

utilizes the integration value, the first count, and the second count to solve a first discriminate function for a first class of objects thereby producing a first discriminate value;

utilizes the integration value, the first count, and the second count to solve a second discriminate function for the second class of objects thereby producing a second discriminate value; and produces the output signal in response to the first discriminate value and the second discriminate value.

* * * * *